US007530526B1

(12) United States Patent
Powers

(10) Patent No.: US 7,530,526 B1
(45) Date of Patent: May 12, 2009

(54) RETAINING DEVICE FOR ROLL DISPENSING APPLICATIONS

(76) Inventor: W. H. Powers, 1020 49th Ave. East, Bradenton, FL (US) 34203

( * ) Notice: Subject to any disclaimer, the term of this patent is extended or adjusted under 35 U.S.C. 154(b) by 0 days.

(21) Appl. No.: 12/053,348

(22) Filed: Mar. 21, 2008

(51) Int. Cl.
*B65H 75/18* (2006.01)

(52) U.S. Cl. ..... 242/598.5; 242/422.5

(58) Field of Classification Search ..... 242/598.5, 242/598, 598.3, 547, 422.4, 422.5, 565
See application file for complete search history.

(56) References Cited

U.S. PATENT DOCUMENTS 1,624,235 A * 4/1927 Hall ..... 225/68
3,291,354 A * 12/1966 Ziebarth ..... 242/422.5
4,093,138 A * 6/1978 Shafer ..... 242/422.5
4,606,485 A * 8/1986 Rankin ..... 225/78
6,446,901 B1 9/2002 Haen
6,648,265 B2 * 11/2003 Goldberg ..... 242/422.5
6,832,739 B1 12/2004 Kraus
7,438,257 B2 * 10/2008 Kennard ..... 242/598.5
2006/0202080 A1 * 9/2006 Kennard ..... 242/598.3

* cited by examiner

*Primary Examiner*—William A Rivera
(74) *Attorney, Agent, or Firm*—Dorothy S. Morse

(57) ABSTRACT

A retaining device positioned against the free end of anything dispensed from a roll to secure it and thereby prevent unattended or surplus dispensing. The device prevents excessive unwinding of paper towels in a motor home or travel trailer due to travel vibration, as a result of wind and other air movement, and where assistance with efficient repeat one-handed separation of a single towel or sheet from a roll is needed. One end of the device mounts to the support surface behind the roll, without any attachment to the holder supporting the roll, wherein a primary contact area adjacent to the device's opposed end becomes biased against the free end to prevent excess dispensing until the roll is completely spent. Dispensing applications include, but are not limited to, commercial and non-commercial use of paper towels on a roll, and retail outlet use of other commercial paper on a roll.

15 Claims, 6 Drawing Sheets

RETAINING DEVICE FOR ROLL DISPENSING APPLICATIONS

CROSS-REFERENCES TO RELATED APPLICATIONS

None

BACKGROUND

1. Field of the Invention

This invention relates to the field of devices used to secure the free end of paper toweling on a roll so that unwanted dispensing is prevented, specifically to a retaining device used for securing the end sheet or free end of anything distributed from a roll when the roll is supported for rotation in a holder detachably secured in a fixed position to a support surface. The present invention comprises a spring-loaded hinge connected between a substantially planar mounting member and an arcuate biasing member having a primary contact area near its upturned distal tip that is used to engage the end sheet or free end of rolled material in an associated holder. When the biasing member of the present invention is securely positioned against the rolled material to prevent unattended and excessive dispensing, at least a portion of the present invention's mounting member is attached to the support surface behind the holder and the rolled material it supports. However, while no direct attachment is made between the holder and the mounting member, the holder can be connected to a support surface directly in front of the mounting member, and as a result thereof, when the holder is tightened against the support surface, it makes immobilizing contact with the mounting member that locks the mounting member against the support surface until such time as the tight connection of the holder to the support surface is released. Even when this occurs, independent attachment of the mounting member to the support surface is desired to make certain that the biasing member is correctly located to effectively fulfill its rolled material engaging function before the holder is secured in place over the mounting member. It is important that the location of the mounting member relative to an associated holder establishes positioning for the biasing member's primary contact area that allows it to remain firmly established against the end sheet or free end of rolled material in the holder until all of the rolled material has been dispensed. However, although there is a defined primary contact area on the biasing member, it must be understood that the actual amount of contact area between the biasing member and the rolled material may vary according to the type of rolled material placed in the holder and the amount of rolled material remaining in the holder. Thus, when the rolled material in a holder is softer and more resilient, and/or more of it is present, it is expected for the amount of actual contact area on the biasing member to at least slightly increase, and for less contact area to be present when less resilient and lesser amounts of rolled material are in the holder. In addition, although the biasing force provided by the spring-loaded hinge causes a firm engagement between the biasing member and rolled material in an associated holder, the engagement is not so firm as to prevent movement of the rolled material under the biasing member in response to a pulling force applied by a user's hand to the end sheet or free end of the rolled material. Rolled material with perforations may be used with the present invention, as well as rolled material without perforations. Further, although it is contemplated for applications of the present invention to include the dispensing of other rolled material in addition to the dispensing of paper towels, it should be noted that the description herein will make exemplary use paper towel dispensing without any intention of limitation. Since the present invention retaining device is mounted behind a holder of rolled material to the same surface used for mounting the holder, its sale is primarily contemplated as an after-market product employed to improve the performance of a detachable holder of rolled material in current use.

One intended application of the present invention retaining device is to prevent excessive toweling distribution in situations where there is a need for frequent one-handed single towel separation from a mounted paper towel roll. Another particularly useful application is to prevent the excessive unrolling of paper toweling from a roll supported by a holder in a motor home or travel trailer where bumps in the road and other travel vibration tends to cause unattended unwinding that can result in excessive distribution of paper towels. Further, wind and air drafts are known to cause unwanted towel unwinding, and the present invention could also be used in association with a mounted paper towel holder positioned where it can be affected at least periodically by the presence of wind gusts and/or other rapidly moving air currents. The paper towel holder used with the present invention can be mounted under a cabinet (preferably when positioned at or above shoulder level but not limited thereto), or in any orientation on a wall or other support surface, to include a vertically-extending orientation, a horizontally-extending orientation, and other orientations in between that are found particularly useful in a specific application or location. Applications may also include, but are not limited to, use with large rolls of commercial paper found in some retail outlets, use in grocery stores, and use to reduce the likelihood that playful pursuits of pets and children in a home directed toward a mounted roll of paper will result in excessive dispensing.

2. Description of the Related Art

Holders used for dispensing paper towels from a roll in a free-standing position are known to have pressure members connected to them that maintain a neat appearance of the toweling and may also assist in the dispensing of single paper towel sheets. One such device is disclosed in U.S. Pat. No. 6,832,739 to Kraus (2004). For paper towel rolls mounted in a horizontally-extending position, unwanted dispensing of toweling is avoided by ratcheted and other means associated with the rotating member upon which the roll is supported. One such device is disclosed in U.S. Pat. No. 6,446,901 to Haen (2002). It is not known in the prior art to have a retaining device similar to the present invention that is configured for securing the end sheet or free end of dispensable rolled material supported for rotation in a holder while the holder is detachably fixed to a support surface, and wherein the device is not attached to the holder and instead is independently attached to the support surface behind the holder. Also, it is not known in the prior art for such a device to have an otherwise substantially planar mounting member with a hinge-shifting bend near its proximal end and be used in combination with an arcuate biasing member having an upturned distal tip that is configured and dimensioned for easy lifting of the biasing member away from the rolled material and into a raised position, which together provide adequate clearance with the holder's support surface for the raised biasing member's distal tip when unobstructed maintenance and other access to the rolled material and its holder is needed. If the hinge-shifting bend of the mounting member and the arcuate profile of the biasing member are not incorporated into the present invention, when the biasing member is moved by a user away from the rolled material, the support surface would possibly interfere and diminish the ease with which rolled material replacement can be accomplished. A simple design for the present invention that uses a low cost spring-loaded hinge and a minimal number of other parts, lends itself to durable construction, reduced manufacturing cost, and reliable use. No other device associated with a holder for rolled material so as to prevent unattended and excess dispensing is known with the same structure, to function in the same manner, or provide all of the advantages of the present invention.

BRIEF SUMMARY OF THE INVENTION

The primary object of this invention to provide a retaining device configured for securing the end sheet or free end of a paper towel roll mounted for rotation in a holder to prevent unattended unwinding, premature dispensing, and/or excessive distribution of toweling. Another object of this invention is to provide a retaining device used in commercial and non-commercial applications for securing the end sheet or free end of other rolled material mounted for rotation in a holder to prevent unattended unwinding, premature dispensing, and/or excessive distribution. A further object of this invention is to provide a retaining device that is usable as an after-market device for holders of rolled material in current use. It is also an object of this invention to provide a retaining device that is independently mounted to the support surface upon which an associated holder is secured, with its mounting member positioned at least in part behind the holder, and without any part of the retaining device being fastened to the holder. It is a further object of this invention to provide a retaining device with simple and durable construction configured for easy, reliable, and long-term repeat use, as well as reduced manufacturing cost. A further object of this invention is to provide a retaining device that facilitates efficient repeat one-handed separation of a single towel or sheet from a roll.

The present invention, when properly made and used, will provide a retaining device employed for securing in place the end sheet or free end of anything distributed from a roll supported for rotation in a holder having a fixed, but detachable, connection to a support surface. However, the present invention is not attached to the holder, instead having an independent connection to the support surface used for the holder. Also, at least part of the mounting member of the present invention is positioned behind the holder. The holder used for dispensing purposes with the present invention can be mounted under a cabinet, or in any orientation on a wall or other surface, to include a vertically-extending orientation, a horizontally-extending orientation, and other orientations in between that are found particularly useful in a specific application or location. Also, the self-closing spring-loaded hinge of the present invention allows for effective securing of the end sheet or free end of a roll irregardless of whether the roll is new or nearly spent. The mounting member and the biasing member can have similar or dissimilar length dimensions, depending upon the intended application. Also, the distal end of the mounting member is preferably secured to a support surface with double-sided tape, or a fastener. In addition, the upturned distal tip of the biasing member is available as a quickly grasped handgrip for use in lifting the biasing member away from the rolled material for unobstructed access to it, as well as placement of new rolled material into the holder associated with the present invention, when needed.

The description herein provides preferred embodiments of the present invention but should not be construed as limiting its scope. For example, variations in the length, width, and thickness dimensions of the mounting member; the length, width, and thickness dimensions of the biasing member; the size of the mounting member relative to the biasing member; the amount of curvature in the arcuate profile of the biasing member; the length, width, and thickness dimensions of the spring-loaded hinge; the type of spring-loaded hinge used; the mounting means used to secure the mounting member against the support surface behind the rolled material; the number of apertures in the mounting member, if any; and the materials from which the mounting member, the biasing member, hinge, and the fasteners are made, other than those shown and described herein, may be incorporated into the present invention. Thus, the scope of the present invention should be determined by the appended claims and their legal equivalents, rather than being limited to the examples given.

DETAILED DESCRIPTION OF THE INVENTION

Figure 1:
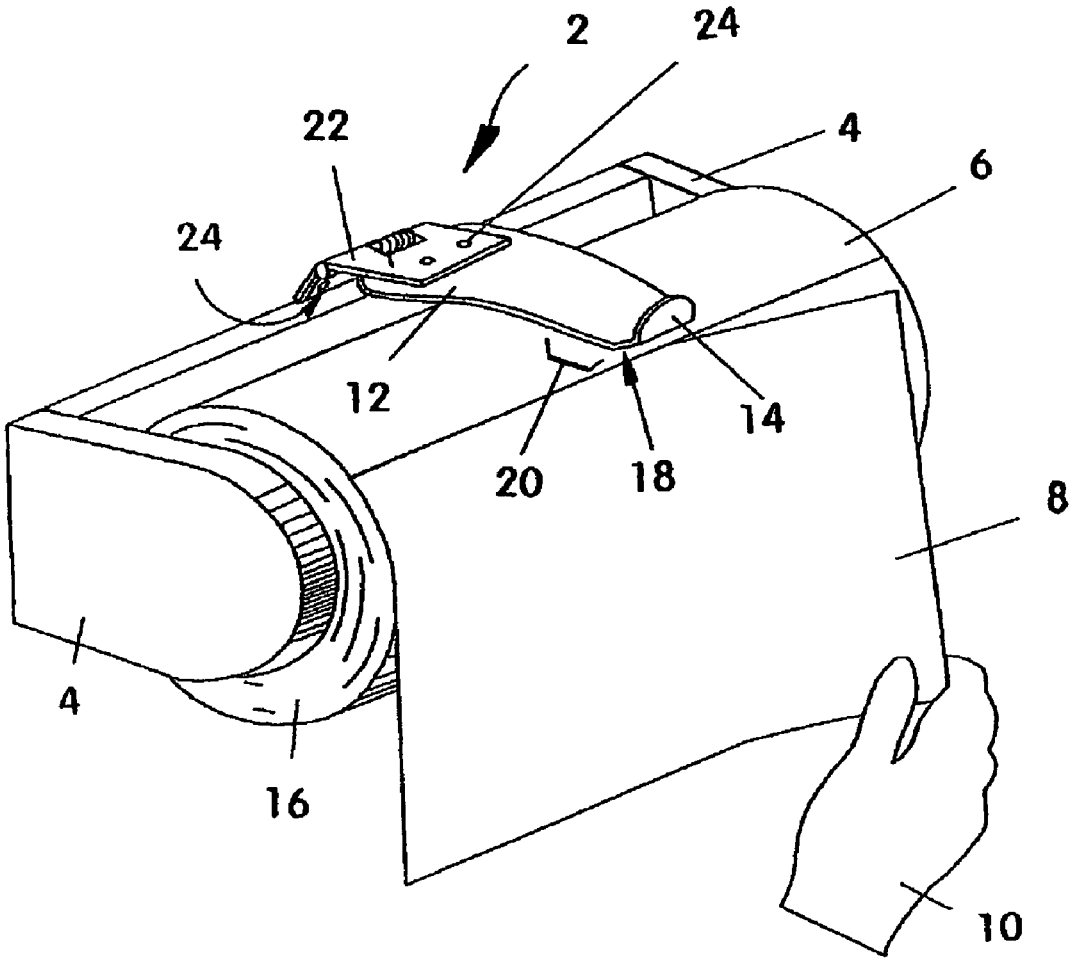
FIG. 1 is a perspective view of the most preferred embodiment of the present invention associated with a holder configured for supporting rolled material for rotation, its mounting member hidden from view behind holder (but shown in FIG. 5), its biasing member visible and positioned above the rolled material, the spring-loaded hinge connecting the mounting member to the biasing member also visible and causing a primary contact area adjacent to the up-turned distal tip of the biasing member to be placed in contact with the top of the rolled material, and further showing a hand demonstrating the one-handed tearing operation achievable through use of the present invention.

The most preferred embodiment of the present invention provides a retaining device 2 configured and positioned for securing the end sheet or free end 6 of rolled material 16 supported in a holder 4 for rotation, with retaining device 2 having an attachment to a support surface (not shown) behind holder 4, but no attachment to holder 4. Retaining device 2 comprises a substantially planar mounting member 28, a substantially arcuate biasing member 12, a self-closing spring-loaded hinge 22 connecting the mounting member 28 and the biasing member 12 to one another, fastening means adapted for securely connecting hinge 22 to mounting member 28 and to biasing member 12, and mounting means adapted for securing mounting member 28 to the support surface behind a holder 4 for rolled material 16 (the same support surface to which holder 4 is attached). Positioning the mounting member 28 of retaining device 2 between holder 4 and the support surface for holder 4 should be accomplished so that the primary contact area of biasing member 12 becomes engaged with rolled material 16 when biasing member 12 is in the compact biasing position shown in FIGS. 1-2 and 4-5, and so that the primary contact area of biasing member 12 can remain so engaged as long as rolled material 16 remains in holder 4. However, as shown in FIG. 3, biasing member 12 can also be moved by a user into a raised position away from rolled material 16 that allows unobstructed user access to rolled material 16 and holder 4, such as for the installation of new rolled material into holder 4 when previous rolled material 16 becomes nearly or completely dispensed. An important component of retaining device 2 is the hinge-shifting bend 36 near the proximal/hinged end of mounting member 28 that places hinge 22 over holder 4 to keep the support surface for holder 4 from interfering with and preventing biasing member 12 from fully moving into a raised position for unobstructed access to holder 4 and rolled material 16. In contrast to the substantially planar mounting member 28, biasing member 12 has an arcuate profile, a primary contact area 20, a distal tip 14, and a tip-raising bend 18 between the primary contact area 20 and the distal tip 14 that prevents contact between distal tip 14 and rolled material 16. Therefore, the raised distal tip 14 is made available to provide an easily grasped hand-hold that can be used for easy lifting of biasing member 12 away from rolled material 16 when maintenance or other access is needed to holder 4 or rolled material 16. It is contemplated during use of retaining device 2 for at least a portion of its mounting member 28 to extend behind holder 4 while the distal/non-hinged end of mounting member 28 is preferably secured to the support surface (not shown) behind holder 4 via a fastener 34 (see FIG. 6) or alternatively via double-sided tape 32 (see FIGS. 3, 4, and 6), with no connection or attachment being provided between mounting member 28 and holder 4. Once mounting member 28 is secured to an adjacent support surface via fastener 34 or double-sided tape 32, and holder 4 is secured in front of mounting member 28 that immobilizes mounting member 28 into a locked position against the support structure for holder 4 until the holder connection to the support surface is released, depending on the length dimension of mounting member 28, the distal/non-hinged end of mounting member 28 may be hidden from view behind holder 4 or in a position extending below holder 4 where it can be visible to a viewer. Although more than one fastener 34 and more than one piece of double-sided tape 32 can be used to secure retaining device 2 to a support surface, for many applications one centrally-located fastener 34 or piece of double-sided tape 32 is sufficient as retaining device 2 is configured for exerting light pressure to the end sheet or free end 6 of rolled material 16, and is not load-bearing.

Thus, mounting member 28 and holder 14 are secured to the same support surface and at least a part of mounting member 28 is positioned behind holder 4. Further, the hinge-shifting bend 36 places hinge 22 above holder 4 instead being maintained in a position directly above the portion of mounting member 28 secured to the support surface. This facilitates movement of biasing member 12 from the compact biasing position where distal tip 14 is in contact with rolled material 16 into the raised position that allows unobstructed access to rolled material 16 and holder 4. Such shifted positioning of hinge 22 further prevents the distal tip 14 of biasing member 12 from making contact with the support surface (not shown) while biasing member 12 is raised away from rolled material 16. If holder 4 is placed into any orientation other than a horizontally-extending orientation, additional fasteners 34 and double-sided tape 32 may be required for secure attachment of mounting member 28 to the support surface. The height of hinge 22 above holder 4 must be adjusted so that the primary contact area 20 on biasing member 12 can become centrally biased against the end sheet or free end 6 of rolled material 16 to secure end sheet or free end 6 against unattended, premature, or excess distribution of rolled material 16 as long as any non-dispensed rolled material 16 remains in holder 4. The present invention retaining device 2 prevents excessive paper towel 16 unwinding as a result of travel vibration in a motor home or travel trailer (not shown), as well as from wind and other air movement, and also facilitates applications where frequent one-handed single towel separation is needed. Although not shown, applications may also include use behind certain styles of mounted toilet paper holder to reduce the likelihood of excessive unwinding during use or as a result of the unattended playful pursuits of pets and children. However, it is not contemplated for the present invention retaining device 2 to be used behind the common ceramic toilet paper holders (not shown) found in households fixed to a tile wall via grout/adhesive. Further, since modern commercial bathroom facilities frequently use multi-roll dispensers to reduce maintenance cost, although toilet paper applications of the present invention are considered possible, any such use is expected to be limited to older construction and simple/cost-efficient construction of facilities in remote locations. Since excessive unwinding of rolled material is prevented by present invention use, no material waste is expected, providing additional cost-reducing benefit. Further, if retaining device 2 is sufficiently large to fulfill its intended function, but not so large as to be oversized for its intended purpose, material waste is also avoided. The biasing member 12 of retaining device 2 is designed to stay in the center of rolled material 16 until its is completely gone, with the size of primary contact area 20 variable according to size and type of rolled material 16 (which would be greater for newly installed and more resilient rolled material 16 and smaller when less resilient rolled material 16 is used or rolled material 16 is nearly spent). Thus, the length dimension of biasing member 12 must not be too long or it would not be able to engage and firmly contact the free end 6 of rolled material 16, particularly as dispensing of rolled material 16 continues and the size of rolled material 16 becomes significantly reduced. It is contemplated for the term rolled material 16 to include the types of commercial paper used in retail establishments.

Figure 2:
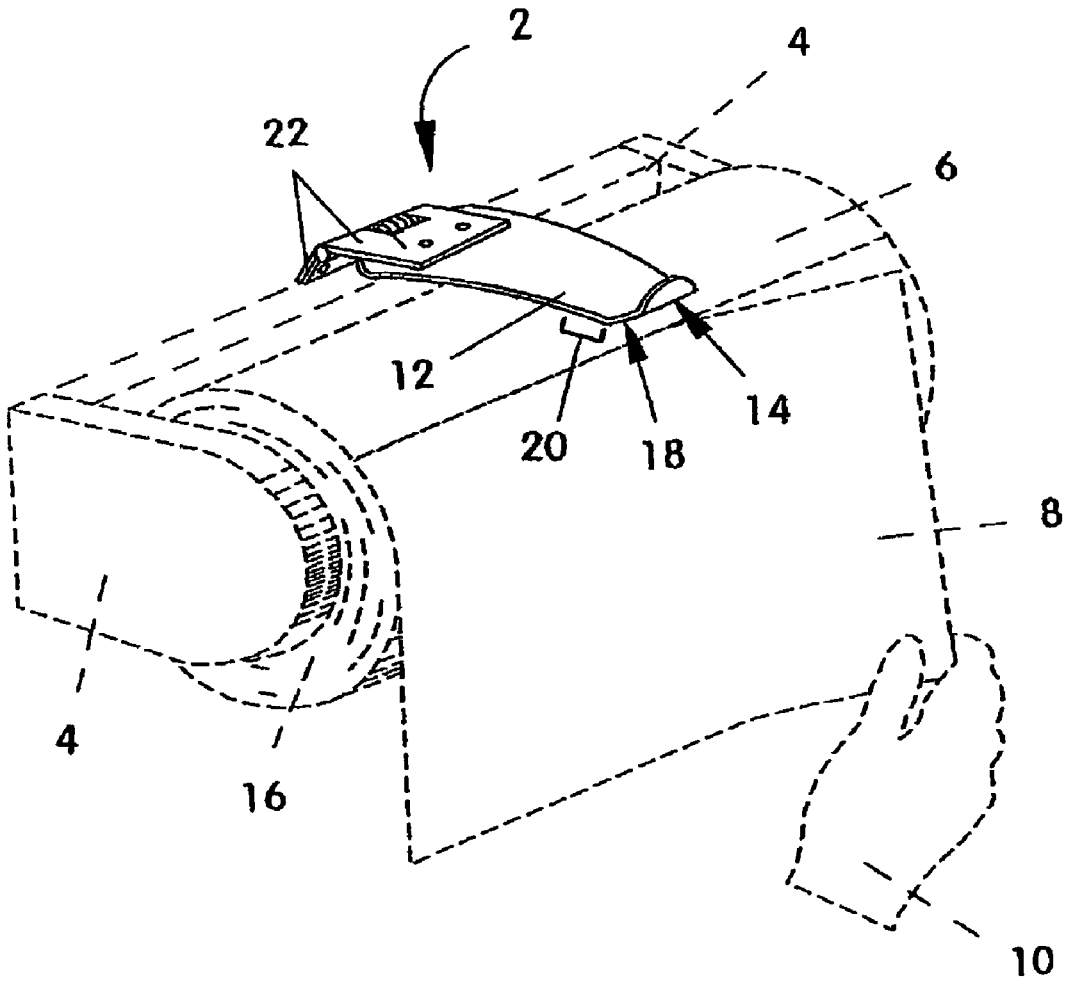
FIG. 2 is a perspective view similar to that shown in FIG. 1, with the holder for dispensing rolled material, the rolled material, the end sheet being torn away from the rolled material, and the user's hand drawn in broken lines to better distinguish the subject matter of the present invention.
Figure 3:
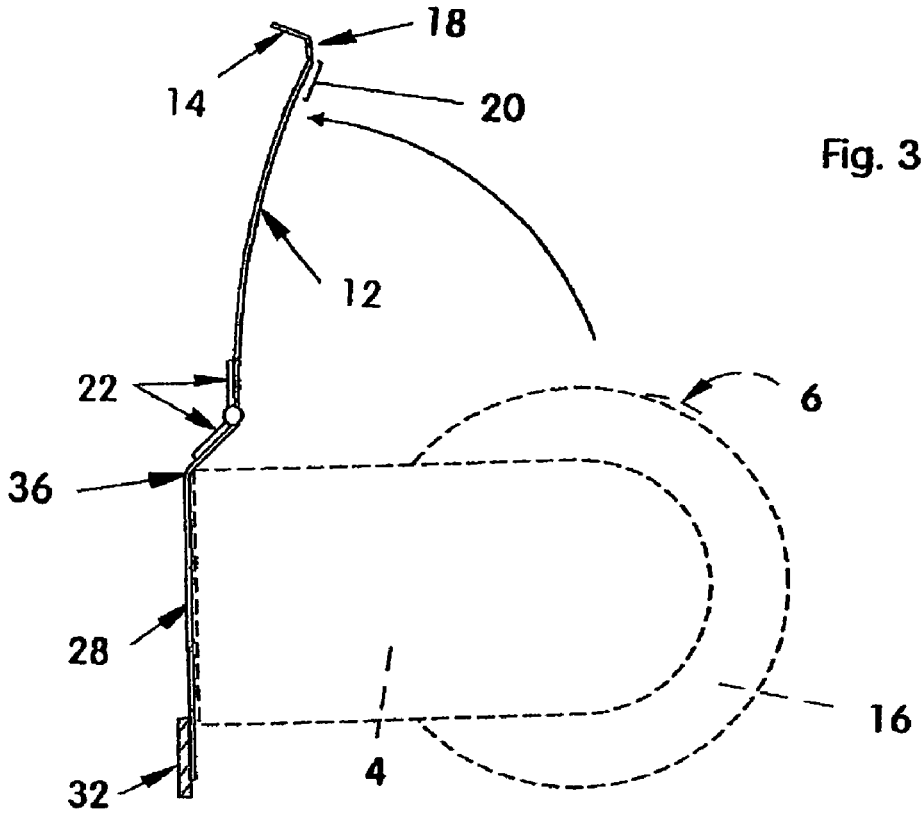
FIG. 3 is a left side view of the most preferred embodiment of the present invention with its mounting member connected to its biasing member via a surface-mounted self-closing spring-loaded hinge, the mounting member positioned immediately behind a holder supporting rolled material for rotation, a piece of a double-sided tape positioned behind the end of the mounting member remote from the hinge, the tape sized and located for attachment to a support surface according to application need, the hinge-shifting bend in the proximal end of the mounting member forcing the hinge away from the support surface and into a position above the dispensing holder, the biasing member in a raised position away from the rolled material, the arcuate biasing member along with its upturned distal end and an adjacent tip-raising bend being used in part to define a primary contact area for engagement with the end sheet or free end of rolled material, and further with a curved arrow showing the direction of biasing member movement into its raised position and broken lines used for the rolled material and the holder.
Figure 4:
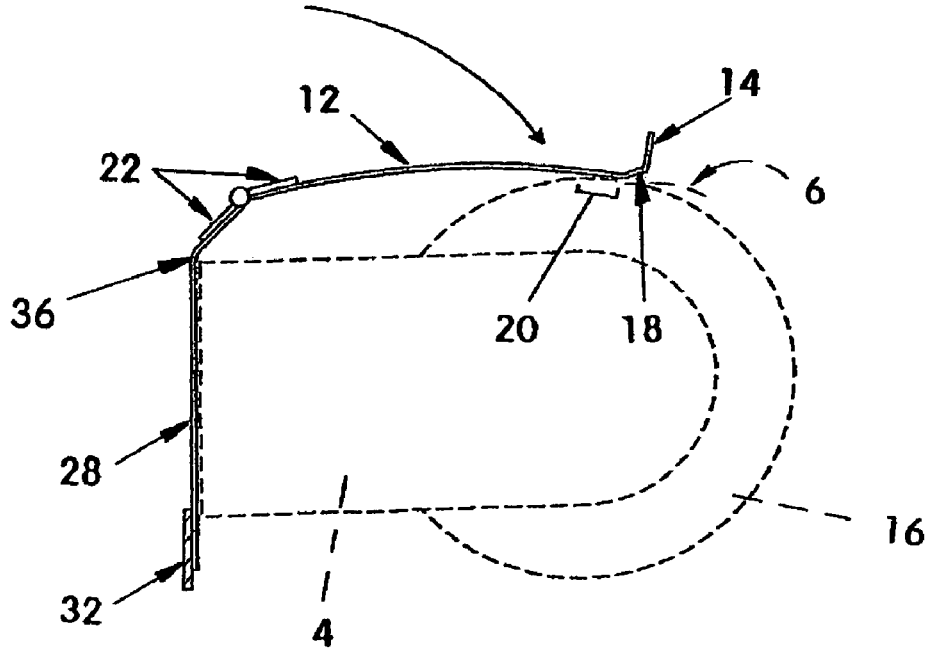
FIG. 4 is a left side view of the most preferred embodiment of the present invention similar to that in FIG. 3, except that the biasing member is no longer in a raised position and a curved arrow shows the direction of biasing member movement as it moves from the raised position the needed compact biasing position where the primary contact area of the biasing member is in continual engagement with the top of the rolled material as long as any rolled material remains supported for rotation in the holder.
Figure 5:
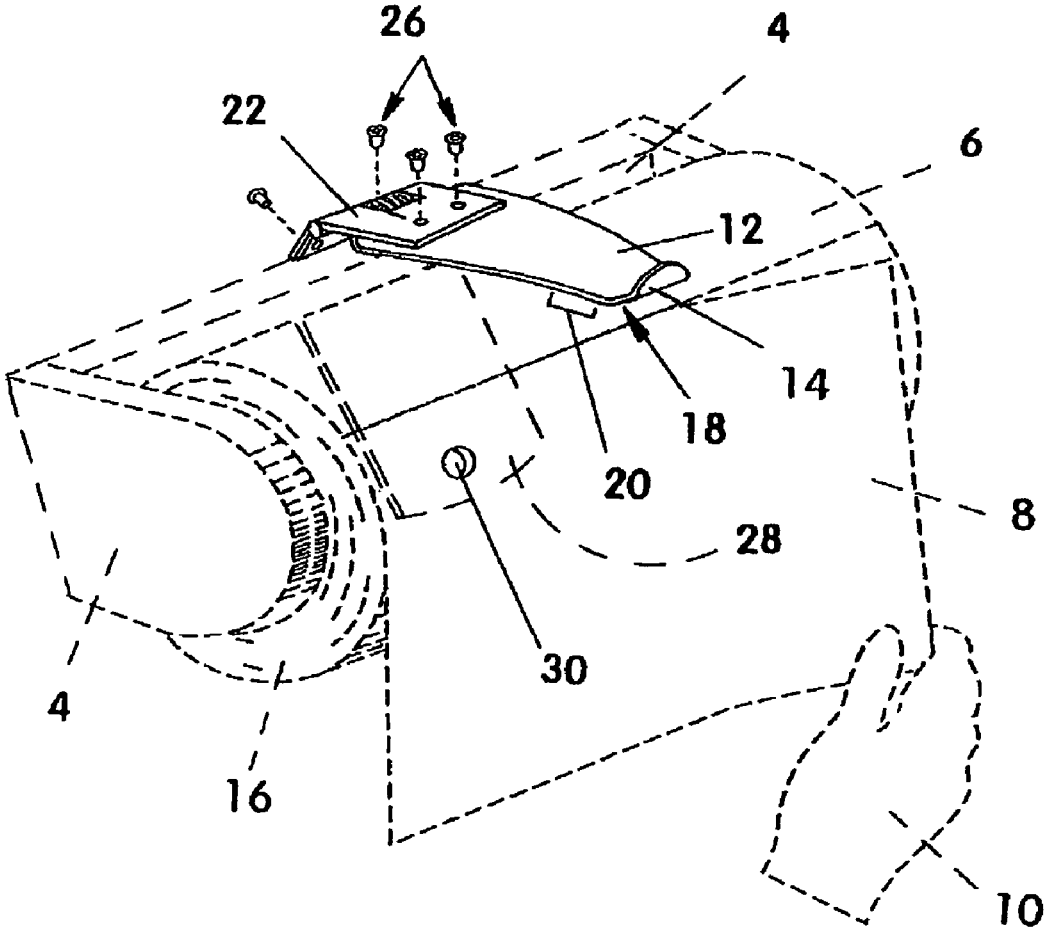
FIG. 5 is a perspective view similar to that shown in FIG. 1, with the exposed portion of the present invention and four hinge-attaching fasteners shown in solid lines, the hidden portion of the present invention shown in large broken lines, and the paper towel holder, rolled material, the end sheet being torn away from the rolled material, and user's hand drawn in small broken lines to better distinguish the subject matter of the present invention.

FIGS. 1, 2, and 5 show similar views of the most preferred embodiment of the present invention retaining device 2 with its mounting member 28 positioned behind holder 4 and its biasing member 12 positioned above rolled material 16 in a position where primary contact area 20 is shown to be engaging the free end 6 of rolled material 16. A user's hand 10 is also shown in FIGS. 1, 2, and 5 conducting a one-handed tearing/dispensing operation, assisted by the grip of primary contact area 20 against free end 6, wherein a user easily obtains a single separated sheet 8 of rolled material 16 without excessive unwinding/dispensing of rolled material 16. In addition, the spring-loaded hinge 22 used to connect mounting member 28 and biasing member 12 to one another is shown in FIGS. 1, 2, and 5 to be in a position extending in part over holder 4 and rolled material 16, with biasing member 12 having an arcuate profile that minimizes contact between rolled material 16 and the portion of biasing member 12 between primary contact area 20 and hinge 22, leaving the primary contact area 20 adjacent to tip-raising bend 18 as the major portion of biasing member 12 that becomes engaged with rolled material 16. Self-closing spring-loaded hinge 22 assists in maintaining contact of biasing member 12 with rolled material 16 so that biasing member 12 is centrally mounted against the free end 6 of rolled material 16, and primary contact area 20 maintains its engagement with rolled material 16 until all of it has been dispensed. Depending upon the application and the resiliency of the rolled material 16, the actual contact area between biasing member 12 and rolled material may vary in size, and be slightly larger when rolled material 16 is newly installed in dispending holder 4, and correspondingly be somewhat smaller when rolled material 16 is nearly spent. The tip-raising bend 18 used in part to define primary contact area 20 also creates an upturned configuration for the distal tip 14 of biasing member 12 directed away from rolled material 16. The configuration of tip-raising bend 18 combined with the upturned positioning of distal tip 14, places distal tip 14 in an easily accessible position for grasping and movement by a user's hand 10, wherein distal tip 14 can be easily used to lift biasing member 12 away from rolled material 16 and into the raised position shown in FIG. 4, such as for maintenance relating to holder 4 or the replacement of rolled material 16 that has been completely or almost completely dispensed. FIG. 1 is a perspective view of the most preferred embodiment of the present invention retaining device 2 positioned with hinge 22 and biasing member 12 over holder 4 and rolled material 16, and with everything illustrated in solids lines, while FIG. 2 is a perspective view similar to that shown in FIG. 1, except that the holder 4, rolled material 16 and its partially separated sheet 8, and the user's hand 10 are drawn in broken lines to better distinguish the subject matter of the present invention remaining in solid lines. FIG. 5 is a view similar to FIG. 2 with only visible portions of the present invention shown in solid lines and everything else illustrated in broken lines, however, holder 4, rolled material 16 and its nearly separated sheet 8, and the user's hand 10 are drawn in small broken lines, while the mounting member 28 behind holder 4 and rolled material 16 is shown in large broken lines. FIG. 5 also shows an optional aperture 30 through mounting member 28, which if present is typically located close to the distal/non-hinged end of mounting member 28. Since no fastener 34 is shown inserted through optional aperture 30 in FIG. 5, it should be assumed that at least one hidden piece of double-sided tape 32 is being used to secure mounting member 28 to the same support surface to which the holder 4 is attached, with the choice of double-sided tape 32 or a fastener 34 remaining an option selected according to user preference when optional aperture 30 is present. FIGS. 1 and 2 further show fasteners holes 24 in hinge 22 used for insertion of the fasteners 26 shown in FIG. 5, which provide the secure connection between one of the opposing ends of hinge 22 and mounting member 28, as well as between the other end of hinge 22 and biasing member 12. Fasteners 26 preferred for use in fastener holes 24 include rivets and bolts, however, any other fastener 26 that can fulfill the same function of securely connecting hinge 22 into its usable position can also be employed. In addition, fastener holes 24 in hinge 22, as well as aperture 30 in mounting member 28, may be configured respectively to provide recessed positioning of fasteners 26 or 34, or not, however it is preferred for at least aperture 30 to have a recessed configuration to avoid any interference of fastener 34 with the operation and/or maintenance access for holder 4, or the needed attachment of holder 4 to a support surface.

FIGS. 3 and 4 respectively show the most preferred embodiment of the present invention retaining device 2 with biasing member 12 in a raised position over holder 4 and no longer in contact with rolled material 16 and biasing member 12 lowered to the compact biasing position where primary contact area 20 engages rolled member 17 close to free end 6. FIGS. 3 and 4 further show mounting member 28 having a hinge-clearing bend 36 in its proximal/hinged end that positions hinge 22 completely above holder 4 and also prevents hinge 22 and upturned distal tip 14 from making contact with the support surface while biasing member 12 is in a raised position. FIGS. 3 and 4 are both left side views of a vertically-extending mounting member 28 and positioned behind a holder 4 supporting ready-to-be-dispensed rolled material 16. FIGS. 3 and 4 both also show a piece of a double-sided tape 28 positioned on the side of mounting member 28 remote from holder 4, for use in securing mounting member to the same support surface (not shown) to which holder 4 is attached, without any direct fastener connection between mounting member 28 and holder 4. However, it is contemplated for holder 4 to be attached in a fixed position to a support surface, which necessitates that the portion of mounting member 28 positioned between holder 4 and its support surface will be in close contact with holder 4 and its support surface, and most often tightly sandwiched between them. Thus, in most applications of the present invention, one would not be able to easily slip mounting member 28 behind a holder 4 already attached to a support surface, unless a cutout area or other accommodation had already been made in the back portion of holder 4 for mounting member 28. In addition, FIGS. 3 and 4 both show rolled material 16 with free end 6 located in an upper position above holder 4 where it is easily engaged by primary contact area 20 when biasing member 12 is in its compact configuration, as shown in FIG. 4. Also, FIG. 3 comprises a left-directed curved arrow showing the direction of biasing member 12 movement away from rolled material 16 to reach the raised position shown, while FIG. 4 comprises a right-directed curved arrow showing the downward direction of biasing member 12 movement toward rolled material 16 to reach the lowered position shown. For use with the present invention, holder 4 may be mounted under a cabinet (best when positioned at or above shoulder level), or in any orientation on a wall or other support surface that are found particularly useful in a specific application or location, to include a vertically-extending orientation, a horizontally-extending orientation, and other orientations in between. Due to the small size of the spring component in hinge 22 and the side view represented, as well as the fact that the spring component of hinge 22 is adequately shown in other illustrations, the spring component of hinge 22 is not shown in FIGS. 3 and 4.

Figure 6:
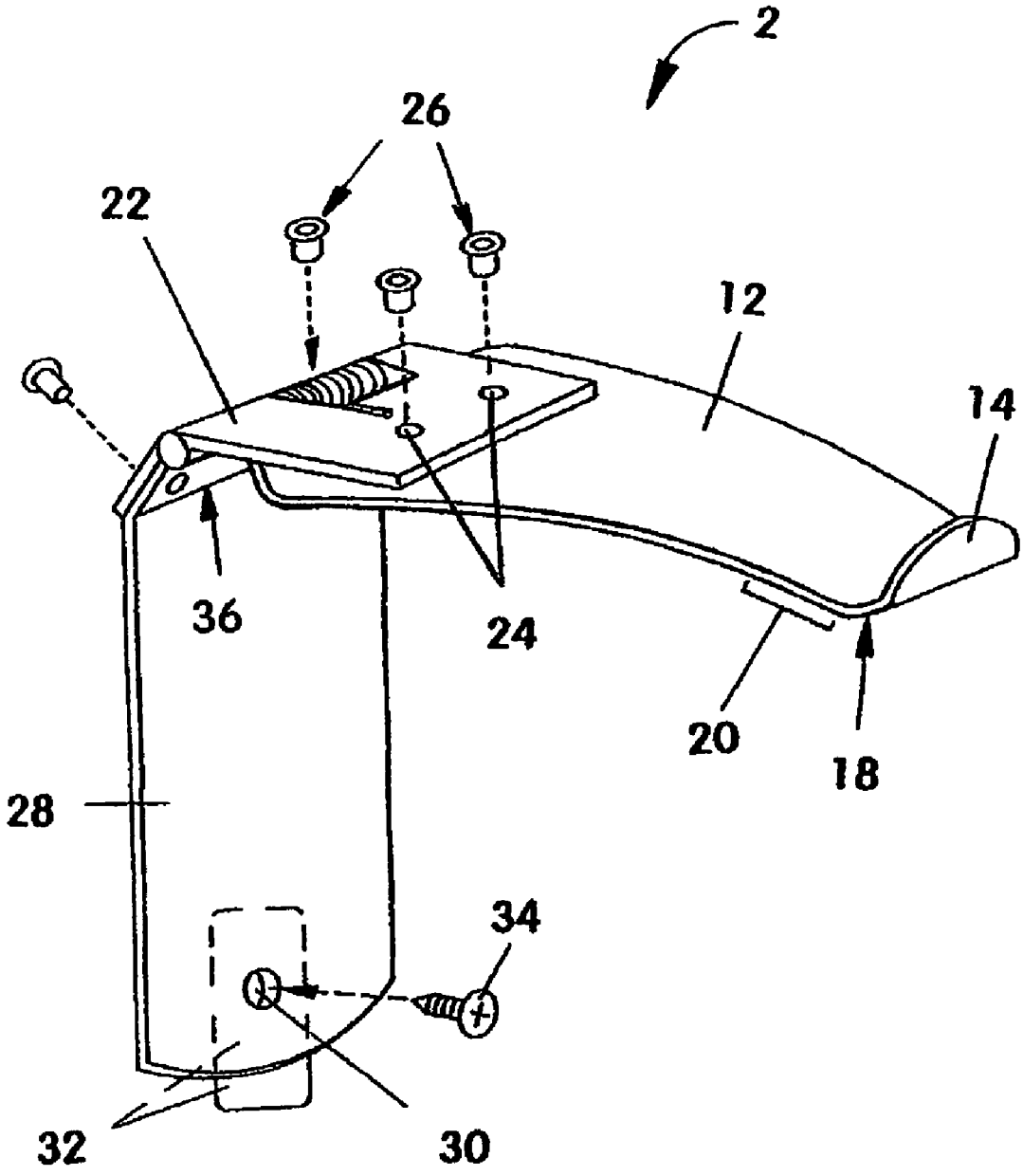
FIG. 6 is a perspective view of the most preferred embodiment of the present invention with the mounting member shown having an optional aperture on its non-hinged/distal end and a hinge-shifting bend on its proximal/hinged end, an arcuate biasing member having an upturned distal tip and a bend near the tip configured to raise the distal tip and create a primary contact area on the biasing member at a spaced apart distance from the distal tip, a self-closing spring-loaded hinge, four hinge-attaching fasteners, and a choice of screw or double-sided tape positioned in near the optional aperture and each configured for holding the mounting member against a support surface behind a holder for rolled material.

FIG. 6 is a perspective view of the most preferred embodiment of the present invention with a spring-loaded hinge 22 connected between a mounting member 28 and a biasing member 12. While hinge 22 may comprise a self-closing lightweight surface-mount spring hinge, it is not limited thereto. FIG. 6 shows mounting member 28 having an optional aperture 30 through its distal end and a hinge-shifting bend 39 close to its proximal/hinged end. Although two fasteners 26 are shown connecting one end of hinge 22 to mounting member 28, the number of fasteners 26 used is not critical as long as the number used is sufficient to provide a secure connection between hinge 22 and mounting member 28. In addition, FIG. 6 shows a biasing member 12 connected to hinge 22 via use of two fasteners 26. The number of fasteners 26 used to connect hinge 22 to biasing member 12 is not critical as long as the number used is sufficient to provide a secure connection between them. FIG. 6 further shows biasing member 12 having an arcuate configuration, upturned distal tip 14, a tip-raising bend 18, and a primary contact area 20 adjacent to tip-raising bend 18. In addition, FIG. 6 illustrates two preferred choices for securing mounting member 28 to a support surface, fastener 34 or double-sided tape 32. The size, perimeter configuration, number, and location of double-sided tape 32 used can be different from that shown, although its use is typically close to the distal/non-hinged end of mounting member 28. Also, the number, size, perimeter configuration, and location of optional apertures 30 and screws 34 used can differ from that shown in FIG. 6. However, since the present invention retaining member 2 is not load-bearing, one aperture 30 and fastener 34 is usually sufficient for connection of mounting member 28 to the same support surface used to attach an associated holder 4. As previously mentioned, optional aperture 30 can be configured for recessed positioning of fastener 34. Further, should more than one optional aperture and fastener 34 be used, although not limited thereto, it is preferred that their positioning be symmetrically balanced in either side-by-side or a vertically stacked orientation. Also, although more than one present invention retaining member 2 may be used with rolled material 16 to prevent unattended or excess unwinding of rolled material 16, in most applications use of a single centrally-located present invention retaining member 2 will be sufficient to fulfill the intended free end 6 securing function.

Figure 7:
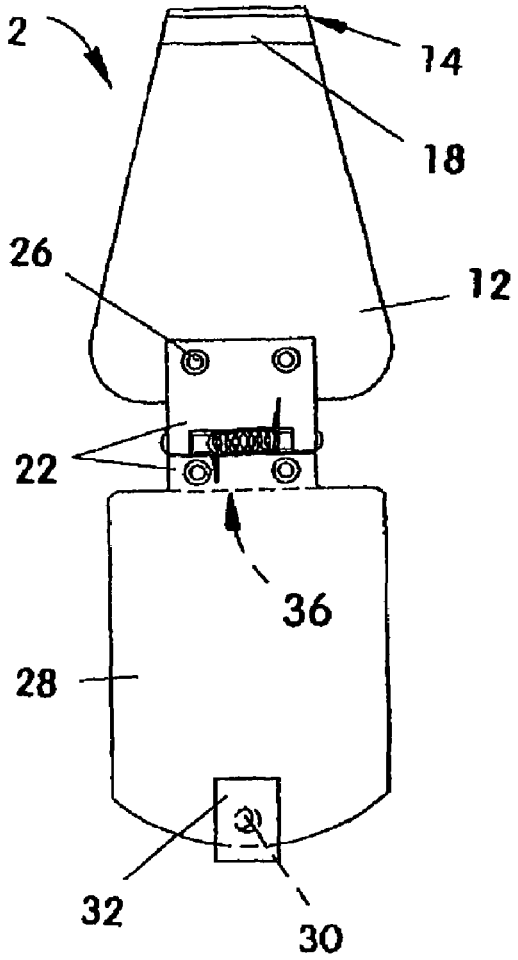
FIG. 7 is a view of the external surface of the most preferred embodiment of the present invention with the mounting member and biasing member connected to one another via a spring-loaded hinge.
Figure 8:
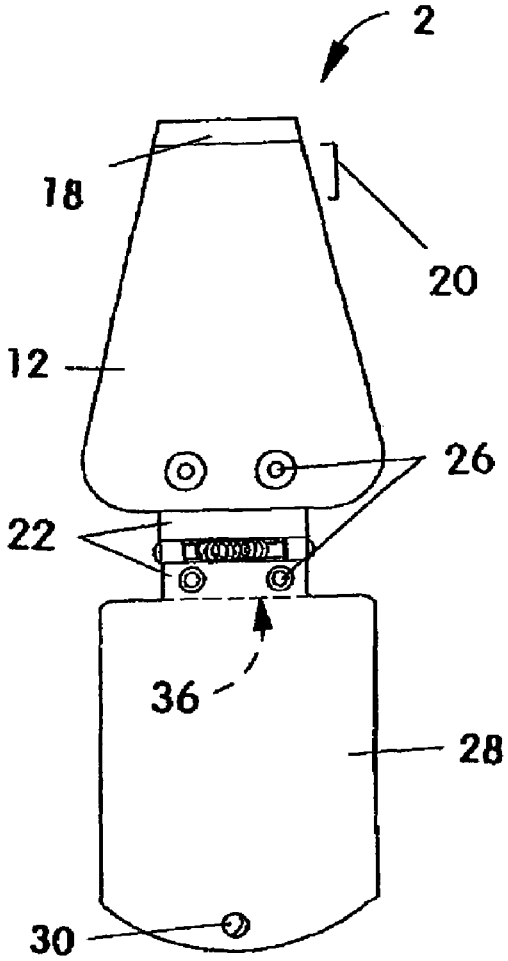
FIG. 8 is a view of the internal surface of the most preferred embodiment of the present invention with the mounting member and biasing member connected to one another via a spring-loaded hinge.

FIGS. 7 and 8 both show the most preferred embodiment of retaining device 2 with biasing member 12 in a raised position rotated away from mounting member 28. FIG. 7 shows the external surface of the present invention with the mounting member 28 and biasing member 12 connected to one another via spring-loaded hinge 22, while FIG. 8 shows the internal surface of retaining device 2. Thus, FIG. 7 shows distal top 14, while distal tip 14 remains hidden from view in FIG. 8. Further, the tip-raising bend 18 in biasing member 12, and the hinge-shifting bend 36 in the proximal/hinged end of mounting member 28, are both shown in FIGS. 7 and 8. FIGS. 7 and 8 also both show the two fasteners 26 preferably used to connect one end of hinge 22 to biasing member 12 and the two fasteners 26 preferably used to connect the opposing end of hinge 22 to mounting member 28. One difference between FIGS. 7 and 8 that is not solely a result of the views therein representing opposite sides of retaining member 2 is that FIG. 7 shows optional aperture 30 in broken lines with a piece of double-sided tape over it, while FIG. 8 only shows the presence of the optional aperture 30. Thus, as shown in FIGS. 7 and 8, when double-sided tape 32 is used, aperture 30 is not needed, but may be present. Also, it is preferred that the type of double-sided tape 32 employed to mount the present invention retaining device 2 against a support surface is easy to pull off for removal, and when a deliberate releasing force is applied, it becomes detached from the support surface without any damage to it. In all the accompanying illustrations showing both mounting member 28 and biasing member 12, each appears to be approximately similar in length dimension to the other. However, the relative length dimensions of mounting member 28 and biasing member 12 are not critical and can vary according to the application. In addition, FIGS. 7 and 8 show the greatest width dimensions of mounting member 28 and biasing member 12 being similar, the greatest width dimension of biasing member 12 being at its hinged end, and the width dimension of biasing member 12 tapering from its wide hinged end to a width dimension reduced by approximately one-half at distal tip 14. The similarity of the width dimensions of mounting member 28 and biasing member 12 is not critical in the present invention and may vary according to the application. Further, although it is contemplated for biasing member 12 to have a generally tapering configuration toward its distal tip 14, it is also contemplated for the amount of tapering present to be able to vary according to application needs.

What is claimed is:

1. A retaining device to be used with a holder supporting rolled material for rotation that is detachably secured in a fixed position to a support surface, without direct attachment between the holder and said device, with the holder instead being connected to the support surface directly in front of a portion of said device so that when the holder is tightened against the support surface, the holder helps to immobilize said device against the support surface and allows contact of a differing part of said device with the free end of the rolled material supported by the holder to prevent unattended, premature, and excessive dispensing of the rolled material, said device comprising:

a mounting member with a distal end, a proximal end in a position opposed to said distal end, and a hinge-shifting bend adjacent to said proximal end;

an arcuate biasing member having a distal tip and an opposed end, a primary contact area near said distal tip, and a tip-raising bend between said primary contact area and said distal tip;

a self-closing spring-loaded hinge connected between said mounting member and said biasing member and in a position overlaying said hinge-shifting bend in said mounting member and said opposed end of said biasing member, said hinge also configured to permit rotational movement of said biasing member toward and away from said mounting member;

fastening means adapted for securely connecting said hinge to said mounting member and also to said biasing member; and mounting means adapted for securing only said distal end of said mounting member in a fixed position against the support surface to which a holder of rolled material is attached and positioning a portion of said mounting member between said proximal end and said distal end so that it becomes immobilized between the holder and the support surface as the holder is tightened against the support surface, wherein when the holder is secured to the support surface, a portion of said mounting member between said proximal end and said distal end becomes positioned between the holder and the support surface, and said primary contact area of said arcuate biasing member becomes engaged with the free end of the rolled material in the holder in a manner that prevents unattended, premature, and excessive dispensing of the rolled material.

2. The device of claim 1 wherein said biasing member has a configuration that tapers toward said distal tip.

3. The device of claim 1 wherein said mounting member has an aperture through said distal end.

4. The device of claim 3 wherein said mounting means is selected from a group consisting of fasteners and double-sided tape.

5. The device of claim 1 wherein said distal tip is sized and configured as a grip for use in rotatably moving said biasing member away from said mounting member.

6. The device of claim 1 wherein said mounting means is selected from a group consisting of fasteners and double-sided tape.

7. The device of claim 1 wherein said biasing member has a configuration that tapers toward said distal tip and said mounting member has an aperture through said distal end.

8. The device of claim 1 wherein said biasing member has a configuration that tapers toward said distal tip and said mounting means is selected from a group consisting of fasteners and double-sided tape.

9. The device of claim 1 wherein said biasing member has a configuration that tapers toward said distal tip, and further wherein said distal tip is sized and configured as a grip for use in rotatably moving said biasing member away from said mounting member.

10. The device of claim 1 wherein said biasing member has a configuration that tapers toward said distal tip, said mounting member has an aperture through said distal end, and said mounting means is selected from a group consisting of fasteners and double-sided tape.

11. The device of claim 1 wherein said biasing member has a configuration that tapers toward said distal tip, said mounting member has an aperture through said distal end, and further wherein said distal tip is sized and configured as a grip for use in rotatably moving said biasing member away from said mounting member.

12. The device of claim 1 wherein said mounting member has an aperture through said distal end and said distal tip is sized and configured as a grip for use in rotatably moving said biasing member away from said mounting member.

13. The device of claim 1 wherein said mounting means is selected from a group consisting of fasteners and double-sided tape, and said distal tip is sized and configured as a grip for use in rotatably moving said biasing member away from said mounting member.

14. The device of claim 1 wherein said biasing member has a configuration that tapers toward said distal tip, said mounting member has an aperture through said distal end, said mounting means is selected from a group consisting of fasteners and double-sided tape, and said distal tip is sized and configured as a grip for use in rotatably moving said biasing member away from said mounting member.

15. The device of claim 1 wherein said mounting member has an aperture through said distal end, said mounting means is selected from a group consisting of fasteners and double-sided tape, and said distal tip is sized and configured as a grip for use in rotatably moving said biasing member away from said mounting member.

* * * * *